United States Patent [19]

Vincent De Araujo

[11] Patent Number: 4,533,799

[45] Date of Patent: Aug. 6, 1985

[54] ELECTRIC SAFETY SWITCH WITH REMOVABLE CONDUCTING ROD

[76] Inventor: Manuel A. Vincent De Araujo, 73390 Chamoux-sur-Gelon, France

[21] Appl. No.: 597,411

[22] Filed: Apr. 6, 1984

[30] Foreign Application Priority Data

Apr. 8, 1983 [FR] France ..... 83 06394

[51] Int. Cl.[3] ..... H01H 35/14

[52] U.S. Cl. ..... 200/52 R; 200/61.45 R; 200/61.5

[58] Field of Search ..... 200/61.08, 61.45 R, 200/61.5, 61.76, 61.79, 61.93, 52 R, 61.04, 153 R

[56] References Cited

U.S. PATENT DOCUMENTS 4,042,797 8/1977 De Araujo et al. ..... 200/61.5 X

FOREIGN PATENT DOCUMENTS 2284178 4/1976 France .

OTHER PUBLICATIONS

Research Disclosure, "Electrical Switch", C. F. Pickering, Feb. 1979, vol. 173, p. 90.

*Primary Examiner*—J. R. Scott

*Attorney, Agent, or Firm*—Ratner & Prestia

[57] ABSTRACT

A switch is provided comprising an insulating case supporting two conducting terminals, and a removable conducting rod coming to bear against the terminals so as to establish electric contact. The rod is held in abutment against a portion of a case and against the terminals by a retaining disk urged by a spring and operable by means of a resetting lever. Auxiliary electric conductors, formed from spring wires, comprise a helical part held in place by the screw shaped terminals and a rectilinear part bearing resiliently against the rod. The auxiliary electric conductors remain in contact with the rod during its reversible resilient travel so as to maintain the electric contact until definite release of the rod. Definite release occurs when the rod exceeds its reversible resilient travel and escapes the case and the retaining disk. The switch is effective to break an electrical circuit in the presence of frost and vibration such as to provide safety on cable transporting pylons.

9 Claims, 5 Drawing Figures

ELECTRIC SAFETY SWITCH WITH REMOVABLE CONDUCTING ROD

BACKGROUND OF THE INVENTION

1. Field of the Invention

The present invention relates to so called positive electric safety switches, with automatic or manual control, for opening an electric circuit.

2. Description of the Prior Art

In well known devices of this kind, a push rod or lever controls and electric contact when it is actuated in certain privileged directions, with end of travel or angle clearance.

Such devices are difficult and even dangerous in use, for the degree of freedom of the feeler element is limited and if it is accidentally or involuntarily driven beyond its limits it may be damaged.

Devices are also known which use the breaking of rigid elements, rods or conducting plates, but these devices have the drawback that the component which is destroyed must be dismantled and replaced by an identical component after each operation.

To overcome these problems, French patent 2. 284 178 proposes an electric switch comprising an insulating case supporting two electric terminals connected to the circuit to be broken. A removable conducting rod, comprising an extension forming operating member, is intended to come to bear against the terminals so as to establish electric contact. The rod is normally held in a stable abutment position, pushed by a retaining piece urged by a spring and operable by means of a resetting lever, against the electric terminals and against a case portion forming a fixed guide. The rod may escape from the retaining piece, after reversible resilient travel, under the action of a force applied to its extension, and thus open the electric contact.

Such a device has the advantage of being able to break the circuit following action on the rod in any direction, the circuit being broken without destroying any member, the rod being able to be replaced by the user as often as desired. However, it has been discovered that this device has the disadvantage of momentarily breaking the circuit, either when it is subject to vibrations, or when the rod is actuated incompletely. In particular, this device finds an interesting application for providing safety on cable transporting pylons, the rod being intended to break the circuit when it is pushed by the cable at the time of a derailment. Frost present on the cable may produce on the rod thrusts and movements insufficient to cause it to be released from the retaining piece, but sufficient to move it momentarily away from an electric terminal and break the circuit. Furthermore, the pylons are subjected to considerable vibrations; the rod, held simply by the retaining piece, may oscillate in its housing against the thrust of the spring and, following vibrations, produce temporary breaks in the circuit. Furthermore, the vibrations produce premature wear of the contacts, causing rust to appear also at certain places.

The document Research Disclosure volume 173 page 90 describes a simplified switch for cameras, comprising two spring wires wound on two respective non conducting terminals. A first end of the two wires forms conductors for the electric connection to a circuit. The second end of one of the wires forms a transverse connecting rod bearing resiliently on the turns of the other wire so as to establish electric contact, this second end being able to be operated by a push rod. In this device, the resilient rod provides the main electric contact.

This document gives no information about the existence and the solution of the problems related to breaking speed and to the presence of temporary breaks during the resilient travel of a switch according to patent No. FR-A-2 284 178.

The present invention has more especially as object to avoid the drawbacks of this known device by proposing improvements for avoiding the temporary opening of the electric circuit due to incomplete actuation of the rod or to vibrations.

Another object of the invention is to provide permanent cleaning of the electric contacts, while avoiding wear and breakage thereof following vibrations.

According to another object of the invention, the improvements increase substantially the breaking speed of the switch, particularly in the case of rod movements which gave rise before to temporary opening of the electric circuit.

SUMMARY OF THE INVENTION

To attain these objects as well as others, the present invention provides auxiliary electric conductors connected to the conducting terminals and remaining in contact with the rod during its reversible resilient travel so as to maintain the electric contact in position until its definite release from the rod. In the following description and in the claims, by reversible resilient travel is meant all the positions which the rod may assume while remaining subjected to the return force of the retaining piece, this return force tending to bring it back into a stable position in abutment against the terminals and against the case part. When the rod exceeds the reversible resilient travel, it escapes from the retaining piece which then tends to push it in the opposite direction to its stable position. This arrangement avoids premature microbreaks or breaks, because the contact is held in position during the reversible resilient travel of the rod, this latter being able to momentarily be disengaged from the conducting terminals.

According to another characteristic of the invention, the auxiliary electric conductors are disposed so that one of the conductors at least is separated from the rod immediately after the rod has gone beyond a reversible resilient travel limit position, beyond which the retaining piece pushes it in the opposite direction to its stable position. Thus the opening of the electric circuit takes place at the moment when the retaining piece pushes the rod, the speed of separation of the electric part then being maximum and breaking of the circuit then being the most rapid possible.

In a particular arrangement, the auxiliary electric conductors are resilient conductors mechanically integral with the case and a part of which may bear resiliently against the rod. They may be formed more especially from spring metal wire comprising a helical part extended by a contact forming rectilinear part, the helical part iself serving as lock washer, and the rectilinear part tending to push the rod perpendicularly to the thrust direction of the retaining piece. The clearance of the resilient piece is thus minimum during the resilient travel of the rod, which reduces the forces exerted on this resilient piece. Furthermore, with the wire bearing against the rod, a good contact is provided since the contact is a pin point.

According to another feature of the invention, the rectilinear part of the spring metal wire is disposed obliquely with respect to the rod when the rod is in a stable position. Thus, during movements of the rod during its reversible resilient travel, the contact point moves both over the metal wire and over the rod, spreading out the wear of the contact and providing self cleaning of its surfaces.

According to another feature of the invention, the retaining piece is a disk, held at its center by a spring and a first face of which bears against the case and against the lateral surface of the rod; the first face and the edge of the disk are covered with a layer of insulating material with a low friction coefficient such as an acetal resin. Such a construction of the retaining piece ensures a double function: insulating the resetting lever and the rod—increasing sliding between the retaining piece and the rod so as to promote and accelerate ejection thereof when it exceeds the reversible resilient travel. The breaking speed is thus substantially increased.

According to another feature of the invention, the rod is constructed so as to reduce or cancel the effect of the vibrations. For that, it comprises a first solid metal part forming a contact with a first terminal, and a second tubular part force fitted at the end of the solid part and forming a contact with the second terminal and operating member. The tubular part is lighter, so that the center of gravity of the rod is close to the contact zone. The applicant has discovered that the amplitude of the vibrations is thus considerably reduced, the retaining piece then being able to hold the rod in contact with the electric terminals. The wear of the contacts, due to friction, is also reduced and their life span increased. In particular, vibrations usually cause the rod to slide over the wires of the auxiliary conductors, causing wear and breakage of the wires in applications with high vibrations. With the present arrangement, the wear produced by the vibrations is considerably reduced.

However, for applications where vibrations are very considerable, it has been discovered that this arrangement is insufficient, and that, according to a feature of the present invention, a rod must be used comprising a first solid metal part forming a contact with a first terminal, to which is added, by means of a metal sleeve forming a contact with the second terminal, a second part made from carbon fibers forming operating member, the sleeve and the carbon fiber part being securely locked together by any reliable means such as a key preventing separation thereof. The lightness of the carbon fiber part thus avoids practically any risk of wear and breakage due to vibrations. In these two embodiments of the rod, possible separation of the tubular part or of the sleeve from the solid part causes opening of the electric circuit, revealing a failure of the device. The safety function of the device is however ensured.

BRIEF DESCRIPTION OF THE DRAWINGS

Other features and advantages of the present invention will be clear from the following description of particular embodiments, with reference to the accompanying Figures in which.

DESCRIPTION OF THE PREFERRED EMBODIMENTS

Figure 1:
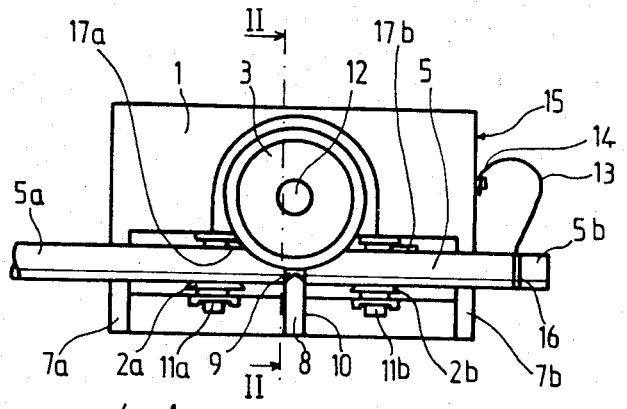
FIG. 1 is a front view of the device of the present invention.
Figure 2:
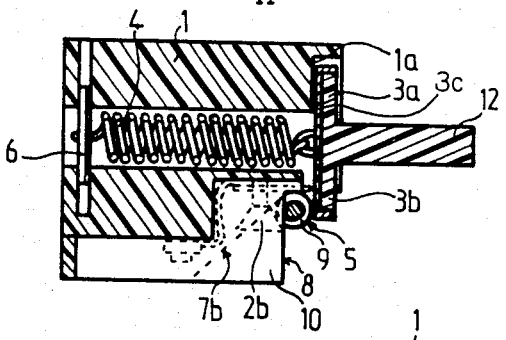
FIG. 2 is a longitudinal section through the axis II—II of FIG. 1.
Figure 3:
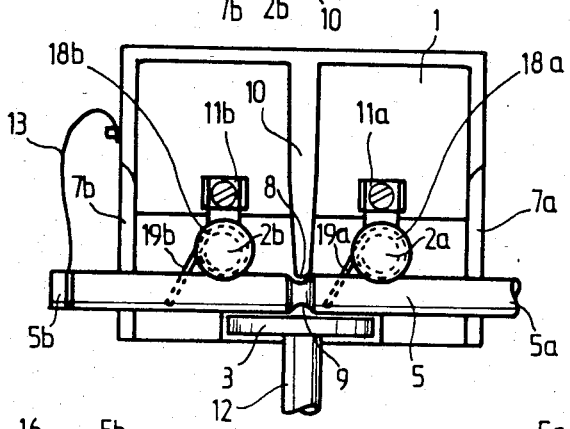
FIG. 3 is a bottom view of the device.

As shown in FIGS. 1 to 3, the switch of the present invention comprises a frame 1 made from an insulating material, to which are fixed two conducting terminals 2*a* and 2*b* in the form of screws with a tapering head. A central longitudinal housing in case 1 receives a traction spring 4 secured to the bottom by a pin 6 and retaining at the other end a disk 3 by its center. The disk bears with its upper portion 3*a* against the front face 1*a* of case 1 and with its lower portion 3*b* against the removable conducting rod 5. Rod 5 is held in resilient abutment by disk 3 on the one hand against the tapering heads of the conducting terminals 2*a* and 2*b* and on the other hand against a ramp shaped portion 7*a* and 7*b* of case 1.

The conducting terminals 2*a* and 2*b* have axes parallel to surface 1*a* and are spaced apart from this surface by a distance sufficient for normally holding rod 5 parallel to this surface as shown in the drawings. The terminals comprise conducting extensions with screws 11*a* and 11*b* for the electrical connection of the switch in a circuit.

Rod 5 comprises at least one extension 5*a* forming operating member. A mechanical action on this extension 5*a* produces the ejection of rod 5 and opening of the electric circuit. The rod also comprises a groove 9 cooperating with the rounded edge 8 of a rib 10 of case 1 so as to define the single correct position in which rod 5 may be inserted behind disk 3, and held in position by the disk against the two conducting terminals 2*a*, 2*b* and ramps 7*a* and 7*b*, the rib 10 of body 1 being engaged in the groove 9 as shown in the Figures.

Rod 5 is connected to case 1 by a cable 13 a first end 14 of which is fixed to one of the lateral faces 15 of the case 1 and the other end of which is fixed axially in a groove 16 of rod 5, the length of the cable being chosen so as to allow correct positioning of the rod as shown in the Figures and the release thereof, but this length being limited so as to prevent inversion of the rod into a position such that groove 9 would always be in relation with rib 10, but in which groove 16 would be in the neighborhood of terminal 2*a* of the case. Thus, the combination of cable 13 and groove 9 and rib 10 prevents any erroneous positioning of the rod with respect to the case.

The face 3*c* of disk 3 by which disk 3 bears against case 1, as well as its edge, are covered with an acetal resin layer, an electrically insulating material with low friction coefficient. Thus, rod 5 slides against the acetal resin surface, this material providing the electric insulation between the conducting terminals 2*a*, 2*b* or the rod and disk 3 itself integral with the resetting lever 12.

Two auxiliary electric conductors 17*a* and 17*b* provide the electric connection between the conducting terminals 2*a* and 2*b* respectively and rod 5 during the whole reversible resilient travel of this rod. In the embodiment shown in the Figures, the auxiliary electric conductors 17*a*, 17*b* are made from spring metal wire having a helical portion 18*a* and 18*b* surrounding screws 2*a* and 2*b* which form conducting terminals and a rectilinear part 19*a* and 19*b* bearing resiliently against rod 5. Screws 2*a* and 2*b* provide the mechanical fixing of helical parts 18*a* and 18*b* with case 1. The rectilinear parts 19*a* and 19*b* tend to urge rod 5 perpendicularly to the longitudinal thrust direction of the retaining piece 3, which direction is parallel to the longitudinal axis of spring 4.

Preferably, the rectilinear parts 19*a* and 19*b* are slanted with respect to rod 5 when rod 5 is in a stable position such as shown in the Figures. The resilience of the spring wires forming the auxiliary conductors 17*a* and 17*b* is chosen so that the rectilinear parts 19*a* and 19*b* remain in contact with the lateral portion of rod 5 until thereof exceeds the limit of its reversible resilient travel. As soon as the rod has exceeded the limit position of its resilient travel, beyond which position the retaining piece 3 pushes it back in the opposite direction to its stable position, the auxiliary electric conductors are disengaged from rod 5 so as to open the electric circuit.

Figure 4:
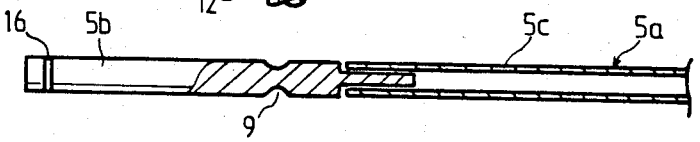
FIG. 4 shows a first embodiment of the conducting rod.

In the embodiment shown in FIG. 4, the rod comprises a first solid metal part 5*b*, forming a contact with a conducting terminal 2*b* and comprising a groove 9. A second tubular part 5*c*, force fitted at the end of the solid part, forms the extension 5*a* or operating member and ensures the contact with the other conducting terminal 2*a*.

Figure 5:
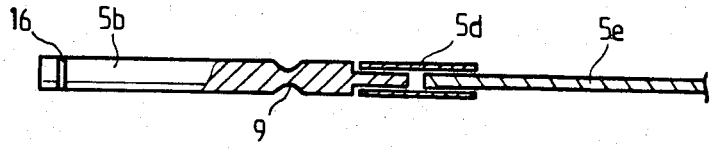
FIG. 5 shows a second embodiment of the rod.

In the embodiment shown in FIG. 5, the rod comprises a first solid metal part 5*b*, forming a contact with the terminal 2*b*. To this first part is added a metal sleeve 5*d* forming a contact with the other conducting terminal 2*b* and in which is engaged a carbon fiber extension 5*e*. The carbon fiber 5*e* and sleeve 5*d* must be very firmly secured together so as to ensure safety under all circumstances. A key may for example be inserted transversely in sleeve 5*d* and fiber 5*e*.

The present invention is not limited to the embodiments which have been more explicitly described, but includes the different variants and generalizations thereof included within the scope of the following claims.

What is claimed is:

1. In an electric switch comprising an insulating case supporting two electric terminals and a removable conducting rod intended to come into abutment against the terminals so as to establish an electric contact and comprising an extension forming an operating member, the rod being normally held in a stable abutment position, pushed by a retaining piece urged by a spring and operable by means of a resetting lever, against the electric terminals and against a case portion forming a fixed guide, the rod being able to escape from the retaining piece after a reversible resilient travel, under the action of a force applied to its extension and thus open the electric contact, auxiliary electric conductors are further provided in which the auxiliary electric conductors are connected to the conducting terminals and remain in contact with the rod during its reversible resilient travel so as to maintain the electric contact until the rod escapes the retaining piece.

2. The electric switch as claimed in claim 1, wherein the auxiliary electric conductors are disposed so that one of the conductors at least is separated from the rod immediately after the rod has gone beyond a resilient travel limit position beyond which the retaining piece urges it in the opposite direction to its stable position.

3. The electric switch as claimed in claim 1, wherein the auxiliary electric conductors are resilient conductors one end of which is mechanically integral with the case and a part of which comes to bear resiliently against the rod.

4. The electric switch as claimed in claim 3, wherein the auxiliary conductors are made from spring metal wire shaped so as to have a helical part extended by a rectilinear part forming a contact, the helical part itself acting as lock washer for a tapered head screw forming electric terminal, the auxiliary conductors tending to urge the rod perpendicularly to the thrust direction of the retaining piece.

5. The electric switch as claimed in claim 4, wherein the rectilinear part of the spring metal wire is oblique with respect to the rod when the rod is in a stable position.

6. The electric switch according to claim 1, in which the retaining piece is a disk, retained at its center by the spring, and the first face of which is in abutment against the case and bears against the lateral surface of the rod, wherein said first face and the edge of the disk are coated with a thickness of insulating material having a low friction coefficient such as acetal resin.

7. The electric switch according to claim 1, wherein the rod comprises a first solid metal part forming a contact with a first terminal and a second tubular part force fitted on the end of the solid part and forming a contact with a second terminal and operating member.

8. The electric switch as claimed in claim 1, wherein said rod has a first solid metal part forming a contact with the first terminal, to which is added, by means of a metal sleeve forming a contact with the second terminal, a second carbon fiber part forming an operating member.

9. The electric switch as claimed in claim 1, wherein said rod comprises a groove engaging on a central rib of the case, and is retained in the case by a cable one end of which is fixed to a lateral face of the case and the other end of which is fixed axially to said rod, the length of the cable being chosen so as to allow correct positioning and escape of the rod, but to prevent reversed positioning thereof.

* * * * *